US005357839A

United States Patent [19]

Brookstein et al.

[11] Patent Number: 5,357,839

[45] Date of Patent: Oct. 25, 1994

[54] SOLID BRAID STRUCTURE

[75] Inventors: David S. Brookstein, Wellesley; John Skelton, Sharon; John R. Dent; Robin W. Dent, both of Foxboro; Donald J. Rose, Sharon, all of Mass.

[73] Assignee: Albany International Corp., Albany, N.Y.

[21] Appl. No.: 126,093

[22] Filed: Sep. 23, 1993

Related U.S. Application Data

[63] Continuation of Ser. No. 551,266, Jul. 12, 1990, abandoned.

[51] Int. Cl.[5] ..... D04C 1/00

[52] U.S. Cl. ..... 87/1; 87/5; 87/8

[58] Field of Search ..... 87/1, 5, 6, 7, 8, 9, 87/11, 13

[56] References Cited

U.S. PATENT DOCUMENTS

| | | | |
|---|---|---|---|
| 1,104,777 | 7/1914 | Cobb | 87/9 |
| 1,104,778 | 7/1914 | Cobb | 87/9 |
| 2,018,596 | 10/1935 | Blaisdell . | |
| 4,312,261 | 1/1982 | Florentine . | |
| 4,615,256 | 10/1986 | Fukuta et al. . | |
| 4,621,560 | 11/1986 | Brown . | |
| 4,719,837 | 1/1988 | McConnell et al. | 87/7 |
| 4,753,150 | 6/1988 | Brown . | |

FOREIGN PATENT DOCUMENTS

| | | | |
|---|---|---|---|
| 113196 | 12/1983 | European Pat. Off. . | |
| 243119 | 4/1987 | European Pat. Off. . | |
| 279585 | 8/1988 | European Pat. Off. . | |
| 405241 | 10/1924 | Fed. Rep. of Germany . | |
| 1026815 | 3/1958 | Fed. Rep. of Germany . | |
| 259147 | 10/1990 | Japan | 87/5 |
| 264055 | 10/1990 | Japan | 87/5 |

*Primary Examiner*—Joseph J. Hail, III

*Attorney, Agent, or Firm*—Kane, Dalsimer, Sullivan, Kurucz, Levy, Eisele and Richard

[57] ABSTRACT

A solid braid structure comprising a plurality of interlocked layers is created by causing a plurality of package carriers of yarn to move along a plurality of defined serpentine paths by track modules. The track modules extend in a first direction to define a longitudinally extending path corresponding to a first layer of the braid structure and in a second direction to provide at least one crossover path between adjacent serpentine paths. The package carriers which move in the first direction create a first layer of braid and, at a crossover path, move between adjacent serpentine paths to cause the yarn forming the first layer of braid to interlock with the braid of an adjacent layer.

7 Claims, 8 Drawing Sheets

| | | |
|---|---|---|
| e | e | e |
| f | f | b |
| | | b |
| | | b |
| | | b |
| e | e | b |
| f | f | f |

| | | | | | |
|---|---|---|---|---|---|
| e | i | e | i | e | i |
| f | i | f | i | f | i |
| | | | | b | i |
| | | | | b | i |
| | | | | b | i |
| e | i | e | i | b | i |
| f | i | f | i | f | i |

SOLID BRAID STRUCTURE

This is a continuation of copending application Ser. No. 07/551,266 filed on Jul. 12, 1990 now abandoned.

BACKGROUND OF THE INVENTION

1. Field of the Invention

This invention relates to a method and apparatus for producing a solid braid structure and to a structure produced by said method and apparatus.

2. Description of the Prior Art

Braided structures are increasingly being used in industry to provide strong, lightweight and non-metallic components. Particular industries requiring such braided structures are the automobile industry and the aircraft industry. The advantage of a braided structure is that the structure has good tensile strength in all directions as opposed to a woven structure which has a relatively limited tensile strength in directions other than those in the direction of the weft and the warp of the yarns comprising the structure.

In order to fit in with industrial requirements, there is a need to provide braid structures in a complex form. By a complex form it is intended herein to refer to a form with a cross-section other than that of a simple rectangule or tube, or a moderate variation therefrom. Typical complex forms which are required are forms having, for example, I, J or C cross-sections. Attempts to form such cross-sections in a braiding apparatus have previously not been particularly successful since, at any area where there is a re-entrant portion, the yarns of the braid tend to span the entrance and therefore defeat the form being sought after.

In other complex forms of structure which do not have re-entrant portions, such as ones sought to have relatively sharp corners or edges, there is a tendency for the braid as laid to be unduly tensioned over the corner or edge and for the braid to open so that the braided structure does not have a uniform strength throughout.

Braided structures are usually of two forms, either those created in a flat form where a braided apparatus has plurality of serpentine tracks and package carriers of yarn travel the tracks interbraiding the yarn dispensed by carriers. At the ends of the paths the carriers are reversed in their direction. If flat multilayer braided structures are required, then a number of layers have to be assembled together and interstitched.

A braid of a generally tubular cross-section, e.g. circular, is able to be made by braiding apparatus in which serpentine paths are defined in a ring and the braid is formed in an area of access of the ring. The package carriers of yarn continuously traverse round the serpentine paths of the ring to lay down the tubular braid as it progresses through the apparatus.

The braid may be formed over a mandrel and this may be of a cross-section other than circular to a limited degree.

Multilayer braided structures have been proposed where radial yarns project from a mandrel and the package carriers of yarn weave their yarn around the radial yarns. Such structures have been difficult to manufacture and a novel and improved method and apparatus for constructing a multilayer braid of flat or hollow form where the various layers are interwoven one with the other during the manufacturing process is described in pending U.S. patent application Ser. No. 501,043 now abandoned. The present invention develops the idea of the multilayer structure described in that Patent Application.

One proposal which has been made previously to form complex braid structures is that the structure should be developed as a series of components which are then joined together. As a C a structure can effectively be constituted of three simple straight structures which are joined at the corners for example by stitching or enveloping in a woven sleeve, the whole can be impregnated if necessary to make a composite braided structure.

Where mandrels are used to create braided structures and a whole range of structures are required there is a disadvantage that a different type of mandrel is required for each size or variation of shape. While this considerably increases tooling and production costs and it is obviously advantageous if the range of mandrels required can be substantially reduced in size or eliminated.

It is thus desirable to seek ways of producing a wide range of braided complex forms, as well as simple forms, in a cost effective manner and in a manner which does not require complex or expensive apparatus and in which the apparatus is able to be adapted swiftly from the manufacture of one complex form to another.

SUMMARY OF THE INVENTION

According to one aspect of the present invention, there is provided a method of producing a solid braid structure comprising a plurality of interlocked layers, a plurality of package carriers of yarn are constrained by track module means to move along a plurality of serpentine paths, the track module means being arranged to extend in a first direction to define a longitudinally extending path corresponding to a first layer of the braided structure and in a second direction to provide at least one crossover path between adjacent serpentine paths, and motion means for moving the package carriers in the said first direction to create a first layer of braid and, at a crossover path, in said second direction to cause a yarn forming part of said first layer of braid to be transported to interlock with the braid of an adjacent layer.

The package carriers may be moved from the adjacent serpentine path at the next adjacent crossover path back to the original serpentine path, and a package carrier may travel in the adjacent serpentine path for only a minimum distance before returning to the original serpentine path.

A plurality of yarn carriers may be caused to travel the serpentine paths in spaced relationship to each other at the same time. The number of package carriers in any one path at the same time is substantially constant. The number of package carriers in any one path is substantially the same as the number of package carriers in the immediate adjacent path.

At least three parallel serpentine paths may be provided and the package carriers may be constrained to travel in each serpentine path. A package carrier in a first serpentine path may be constrained to travel into the immediately adjacent serpentine path and then into the next adjacent serpentine path; alternatively a package carrier may be constrained to pass from a central serpentine path to each of the serpentine paths on either side thereof. Preferably the package carriers are constrained to return to the first serpentine path before one circuit of the path is completed.

The package carriers may be constrained at the end of each serpentine path to reverse their direction and to follow a substantially parallel serpentine path to the original serpentine path to interbraid the yarns of package carriers traversing the paths to form a flat braid structure. Alternatively the track module means may be arranged in a continual circuit to form a cylinder and in which the package carriers are constrained to follow a circular path to form a circular braid structure.

The resultant braid structure may be of an irregular form and the method includes assembling a plurality of track modules each defining a part of a serpentine path, in a configuration equating to the irregular form of structure to be created and causing the package carriers to traverse serpentine paths created by the track module means to create the irregular form of braid structure. A crossover path may be provided on one side only of a track module or on both sides of a track module. The track modules may be arranged such that no crossover path occurs at the extremity of the assembly of the modules and the yarn carriers are not constrained to move in the second direction at the said extremities.

A plurality of static package carriers may be provided and yarn may be dispensed from these static carriers to be interbraided with yarn dispensed from the movable package carriers.

In a further aspect of the present invention, there is provided apparatus for the production of a solid braid structure comprises:

- a two dimensional array of rotatable horn gears in toothed engagement,
- driving means for driving said array, each horn gear being arranged to rotate in a direction contrary to each interengaging gear,
- track means overlaying said array, and
- a plurality of yarn package carriers movable along said track means by said horn gears in which
- said track means comprises a plurality of track modules, which together define a plurality of serpentine paths extending in a first direction, each serpentine path corresponding to a braid layer in said structure and in which selected track modules include at least one crossover path section extending in a second direction between one serpentine path and the next adjacent serpentine path to cause or allow package carriers to move between adjacent serpentine paths to effect interbraiding of yarns between adjacent layers, the number of carriers in any one serpentine path at any one time remaining substantially constant throughout the braiding operation.

Each package carrier is adapted to dispense yarn as it moves in a manner well-known in the art, to build up a braid at a braid forming station.

The two-dimensional array of rotatable horn gears is preferably represented in modules of 2×2 blocks of gears, the gears thus being arranged in a square formation and each gear intermeshing with the two adjacent gears.

Preferably there is a separate track module associated with each gear module, although one track module may be associated with a plurality of gear modules.

A track module may have a crossover path section on one side only or may have a crossover path section on both sides to effect an out module changeover. There may be one or a plurality of crossover path sections and out module changeovers in each track module and the track modules can be assembled so as to permit a variety of configurations of serpentine paths to be constructed.

A base board may be provided on which a plurality of gear modules can be arranged in infinite array and over which the track modules are positioned. The base board may also include means for incorporating turnaround gear arrangements at the end of a serpentine path to enable the flat interbraided braid structure to be completed. Alternatively, the base board may be of a circular form so that a hollow tubular braided structure can be constructed. The base board may itself be or follow the internal surface of a cylinder and the yarns dispensed by each of the carriers may converge at a braiding station located at or in the region of the cylinder axis.

In a variation the track modules may selectively be provided with package carriers for dispensing yarn in an axial direction.

The invention also includes within its scope a novel braid structure made by the method and apparatus of the invention and also a braid reinforced composite in which the reinforcement may include suitable resin material.

An example of the application of the method and apparatus and modifications thereof incorporated in the invention will now be described with reference to the 17 Figures of the accompanying drawings.

BRIEF DESCRIPTION OF THE DRAWINGS

In the drawings FIGS. 1, 2 and 3 are illustrative of existing, conventional apparatus and techniques in which:

FIG. 1 shows a drive module of a conventional braider;

FIG. 2 shows a corresponding track module for the drive module of FIG. 1;

FIG. 3 shows an array of the drive and track modules of FIGS. 1 and 2 for a length of braider to create a single layer of braid;

FIG. 10*i* shows a module combination which does not use the interlacing method of the invention but which can be incorporated in certain applications and variations of the invention. FIG. 10 also shows on the right hand side of each module combination a block schematic design structure;

DETAILED DESCRIPTION OF THE PREFERRED EMBODIMENTS

Figure 1:
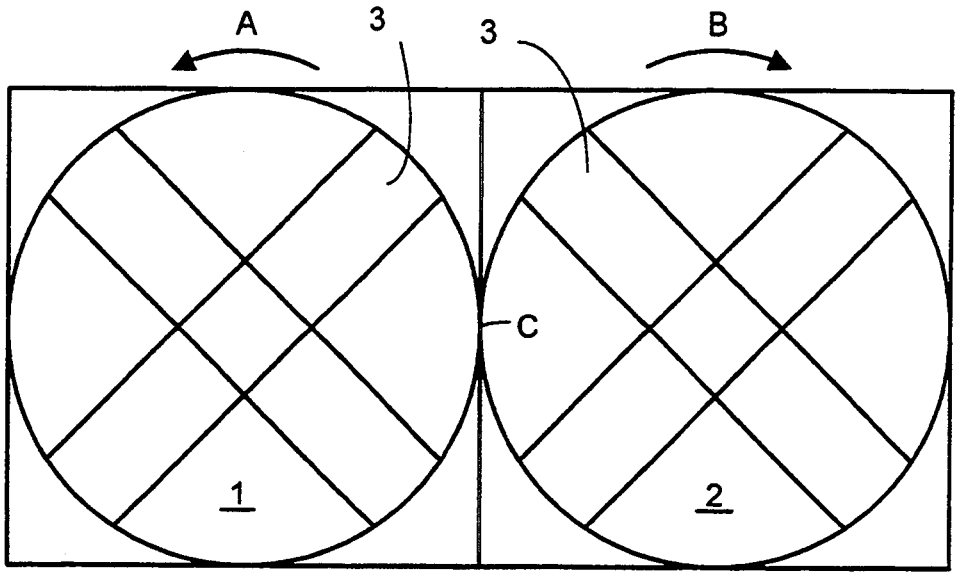
FIG.1 PRIOR ART
Figure 2:
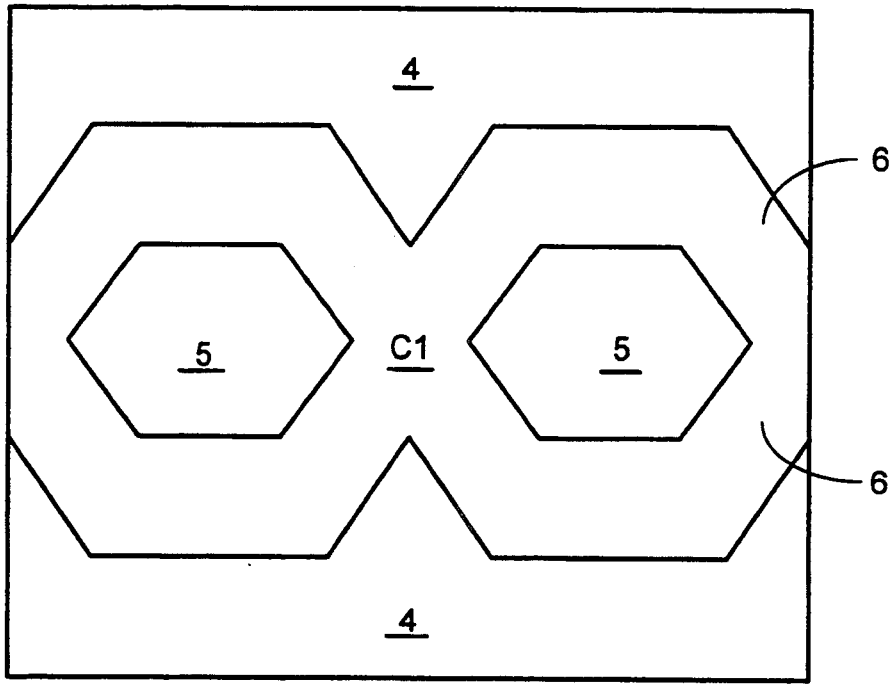
FIG.2 PRIOR ART
Figure 3:
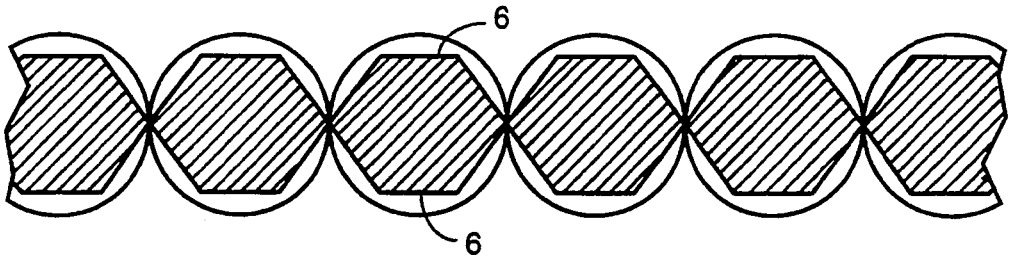
FIG.3 PRIOR ART

Referring now to the drawings and particularly to FIGS. 1, 2 and 3 thereof. These Figures show the principles employed in a conventional apparatus for creating a flat braid. Such apparatus uses a method of braiding which produces a single layer and, if a multiple layer structure is to be provided, then a number of the layers are laid down one on top of the other.

A basic conventional braiding apparatus comprises a track carrying a pair of serpentine paths, along which package carriers carrying filaments of the yarn material being braided travel to interbraid the filaments. The package carriers are caused to travel along the serpentine tracks by engagement of a member depending through the tracks from each package carrier, which member is engaged in slots in a rotating gear, situated below the track. There is a plurality of such gears each of which is intermeshed and which are usually driven by a common drive and adjacent gears are rotated in opposite directions.

A typical drive module and gear arrangement is shown in FIG. 1 where two gear wheels 1 and 2 are shown to be intermeshed and the indication of their direction of rotation is shown by the arrows A, B. Each gear wheel 1, 2 has respective slots 3 which receive depending elements (not shown) of a yarn package carrier and which, as the respective gear rotates in the direction of the arrows A or B, causes the yarn package to move along the track superimposed over the gear. Depending on the layout of the track there will be a transfer of the package carrier between gears 1 and 2 at the point such as C where the two gears intermesh and the slots 3 coincide. If reference is also made to FIG. 2 it will be seen that the corresponding track module comprises two end plates 4 and two central quoits 5, suitably supported above the gear wheels. The plates 4 and quoits 5 are separated by serpentine paths 6.

The track module is positioned directly above the drive module of FIG. 1 and the centres of the quoits 5 are coincident with the centres of rotation of the gear wheels 1, 2. Thus at the point C of the drive module it will be seen that there is a coincidence with the cross-over point of the two serpentine tracks 6 and this is indicated as C1 on the track module.

Depending on the width of each layer of braid to be manufactured, a plurality of track and drive modules are arranged in tandem so as to give a linear array as shown in indicative form in FIG. 3. At the end of the array (not shown) there is no transfer and a package carrier continues fully around the quoit 5 of the last track module which is specially shaped to transfer from one serpentine track 6 to the other. This will be explained further with reference to FIG. 8. Thus as the package carriers traverse along the serpentine track 6 the filaments are continuously interbraided and a layer of flat braid is built up.

Since each layer made according to the apparatus of FIGS. 1 to 3 is independent of an adjacent layer it is necessary, according to the known art, in order to build up a firm braid structure for separate interlacing of the layers to take place. However, it is preferable, in order to make a strong braid structure, to interlace the layers securely during manufacture.

This can be done by modifying the principles of the apparatus of FIGS. 1 to 3 to create at least two layers of material simultaneously and to ensure that the filaments from the package carriers of each layer travel out of the serpentine path of that layer into the serpentine path of the adjacent layer. The apparatus of the invention requires a basic novel combination of drive modules and track modules, as is shown for example in FIGS. 4 and 6 to which reference is now made, in order to produce an interlocked multilayer braid structure.

Figure 4:
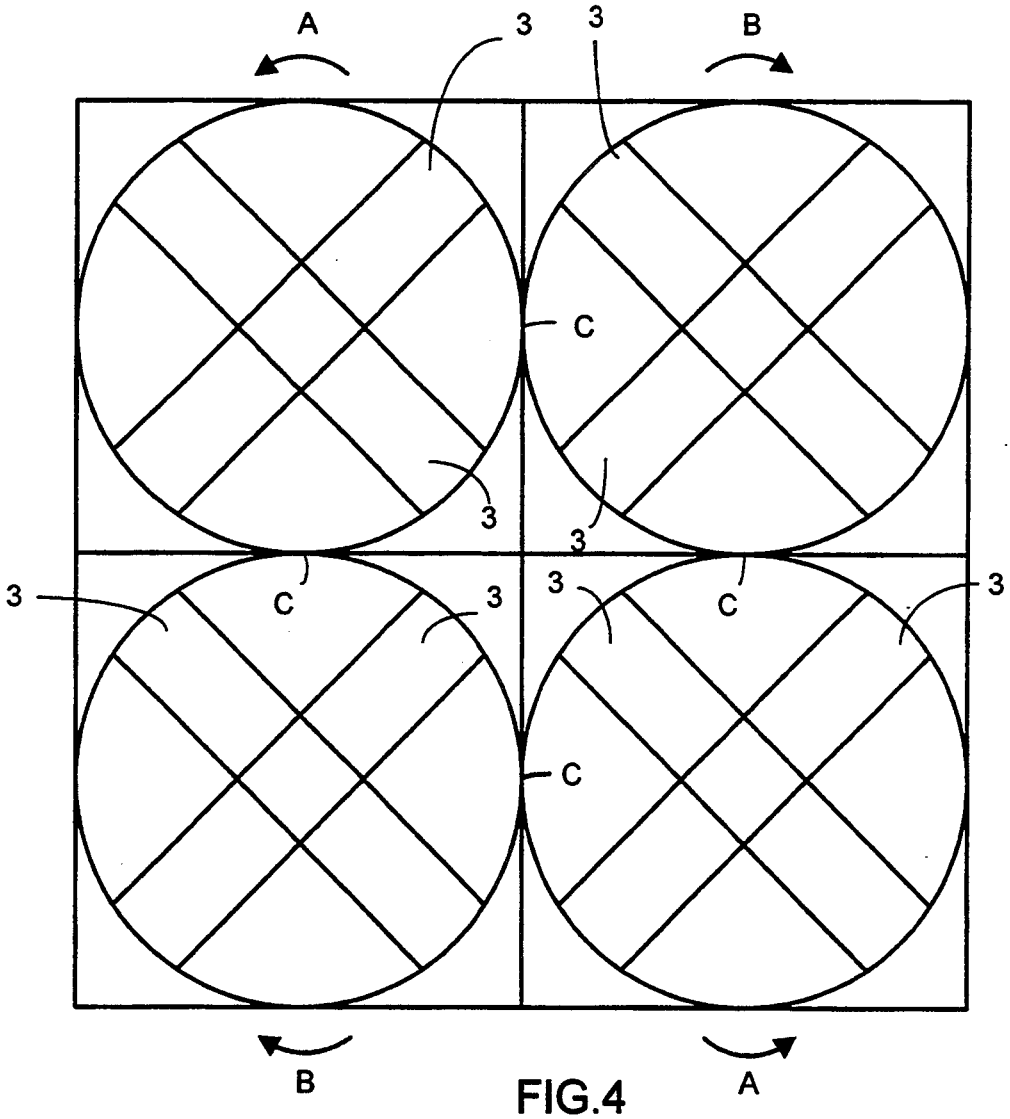
FIG. 4 shows a drive module of apparatus in accordance with the invention.
Figure 5:
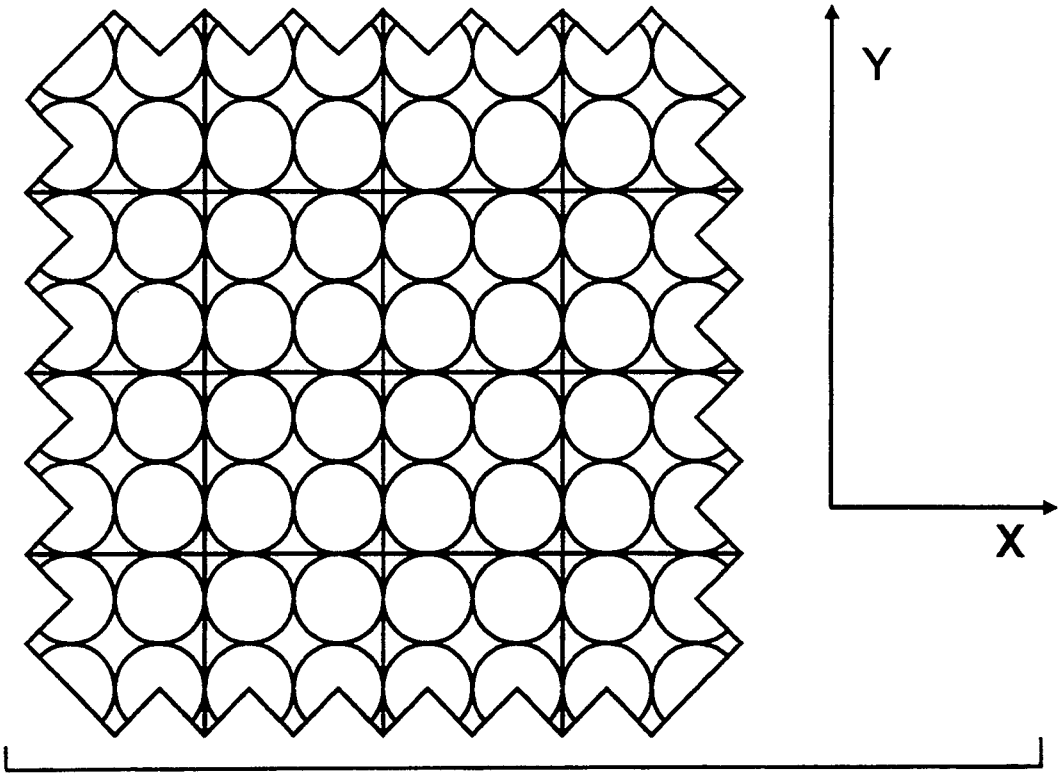
FIG. 5 illustrates the assembly of plurality of the drive modules of FIG. 4 as part of a generic infinite array.

In FIG. 4 the original gear wheels 1, 2 are supplemented by further gear wheels 11, 12 and each gear wheel has four slots 3 corresponding to the slots 3 of FIG. 1. The four gear wheels are arranged in a block with each gear wheel intermeshing with the two immediately adjacent gear wheels and the directions of rotation are as indicated as before by the arrows A, B in FIG. 4. A plurality of these modules can be arranged in any configuration and FIG. 5 shows schematically part of a generic infinite array of drive modules. All the drive modules in FIG. 5 are identical with those shown in FIG. 4.

Figure 6:
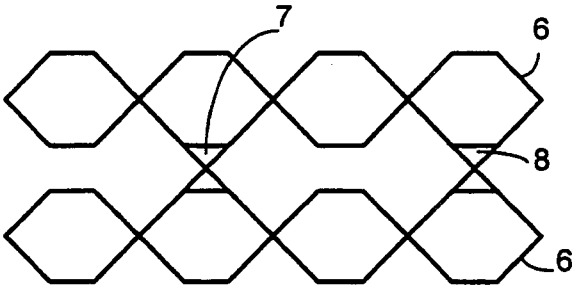
FIG. 6 shows the typical track module in accordance with the invention.

In combination with each pair of drive modules of FIG. 4 it is necessary incorporate a track module and the layout of a suitable track module is shown in FIG. 6. The track module of FIG. 6 is such that the package carriers move during one complete traverse of each serpentine path between the two layers being simultaneously laid down. At the areas 7 and 8 there are cross-over points which are indicated by the notation of a horizontal line in the Figure. A study of FIG. 6 shows that there are effectively two circuits superimposed on each other and as the package carriers are caused to progress about these circuits defined by the serpentine tracks the yarn from each carrier will braid in a first layer and then carry the filament into the adjacent layer to interbraid with the filaments in that layer before returning to the original layer. The modules of FIGS. 4 and 5 indicate the essence of the invention and from which a large number of variations of interlaced braid structures can be derived.

Figure 7:
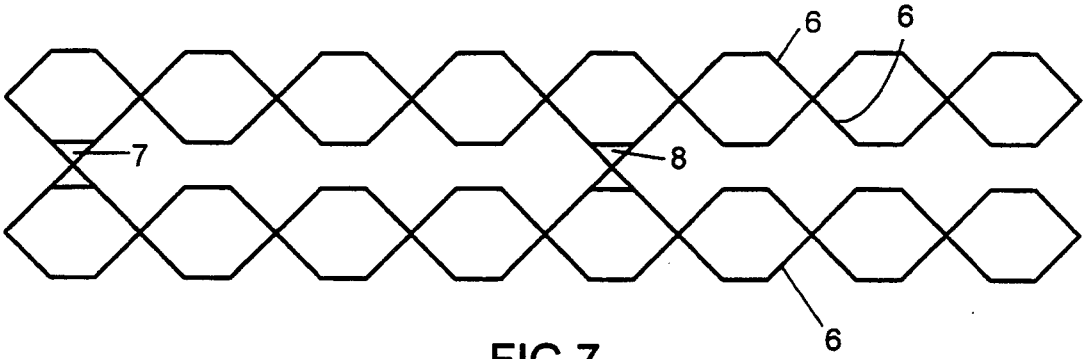
FIG. 7 shows a derivative track module of FIG. 6 with a reduced crossover density.

In FIG. 7 a variation of the basic track module shown in FIG. 6 is illustrated and this is only one of several variations which can be achieved. The track module of FIG. 7 does not require the interlacing yarn to travel into the adjacent layer as frequently as the module of FIG. 6. FIG. 6 indicates apparatus which allows the maximum amount of interlacing possible, whereas with the track module of FIG. 7 a reduced amount interlacing is obtained which is, in fact, half that of FIG. 6. It will be appreciated that there are a number of variations of the track modules and that whilst in FIG. 6 there are eight gear wheels to each track module, in FIG. 7 there are sixteen gear wheels to each track module.

Figure 8:
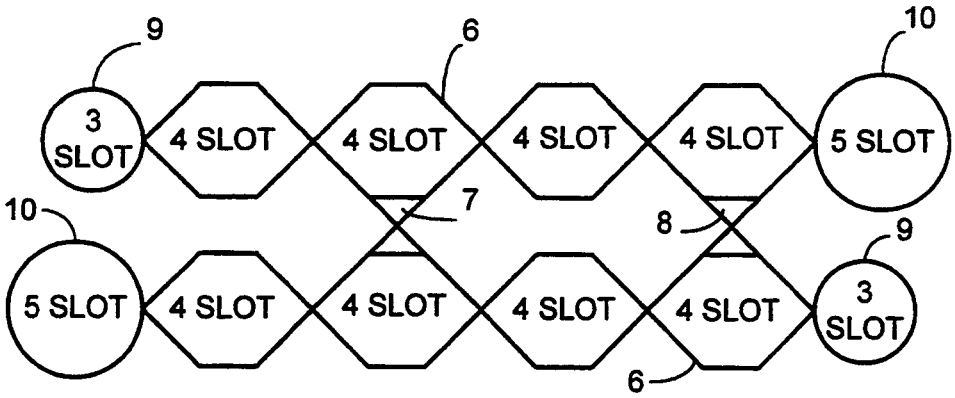
FIG. 8 shows the track modules of FIG. 6 with turnaround features in a typical configuration of modules.

With a basic track module as shown in FIG. 6 a very narrow braid can be created. Generally there would be a number of such modules arranged in tandem but for the most simple case, the braiding apparatus would be set up as shown in FIG. 8, to which reference is now made, with turn-around gear wheels 9, 10 at the end of each serpentine path 6. These turn-around gear wheels would have either one less or one more slots than the number of slots in the gear wheels 1, 2, 11, 12. Thus in FIG. 8 the turn-around gear wheels are 9 indicated as having three slots, whereas the turn-around gear wheels 10 are indicated as having five slots. The turnaround wheels have a special configured circular track module associated with them to cause the package carrier to complete a loop at the end of each row of track modules.

Figure 9:
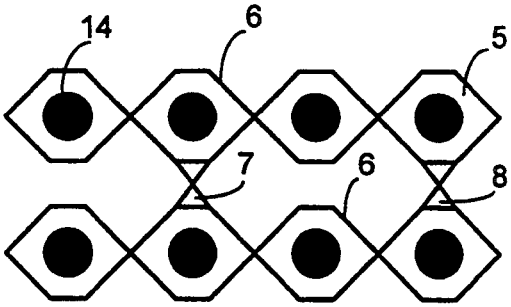
FIG. 9 illustrates a modification of the apparatus to incorporate axial yarns into a braided layer.

It is possible to create a module which has reinforcing yarn filaments which are laid in the direction of manufacture of the flat braid. If the package carriers are considered to move in an X and Y direction, as indicated in FIG. 5, the reinforcing filaments would be in the z direction out of the plane of the paper and at right angles thereto. In this case, the filaments are dispensed from stationary package carriers located at the centre of the central quoits 5 of the track modules. This is shown in FIG. 9 where the reinforcing or axial filaments are shown at 14.

It has been stated above that there are a number of configurations of the serpentine track which can be used to form a track module. In fact, in practice, a single module of the type described with reference to FIG. 6 would only have limited application and therefore it is necessary, in order to take maximum advantage of the invention, to produce a set of modules which are capable of assembly together in a variety of combinations to provide a wide range of interlocked multilayer braid structures. With certain exceptions, it is necessary that each of the modules should have the ability of creating two adjacent layers of braid which are interlocked together. This means that the serpentine paths must be such that a package carrier creating one layer travels from its original path to the path of the adjacent or contiguous layer and then back to the path in the original layer. In doing this it provides an interlock of the yarn between the two layers and the more often that the package carrier transfers between the layers, the stronger the interlock becomes.

In this example each module of a set will include two gear modules and one track module. The gear module will have four gears in the X direction and two gears in the Y direction.

The modules of FIGS. 6 and 7 so far described work well to provide interlocking between two adjacent layers where the layers are created by one track module or a line of similar modules. It is necessary in building up a large structure of some depth for other layers also be interlocked to the original layers. Thus if a plurality of modules are arranged to create a structure having more than two layers it is necessary that the modules are configured so that the package carriers travel from one module into the next module and back to the original module at crossover points. Hereinafter, where this occurs reference will be made to an "out-module changeover" and where the crossover between layers occurs within the module it will be referred to as an "in-module changeover".

Figure 10:
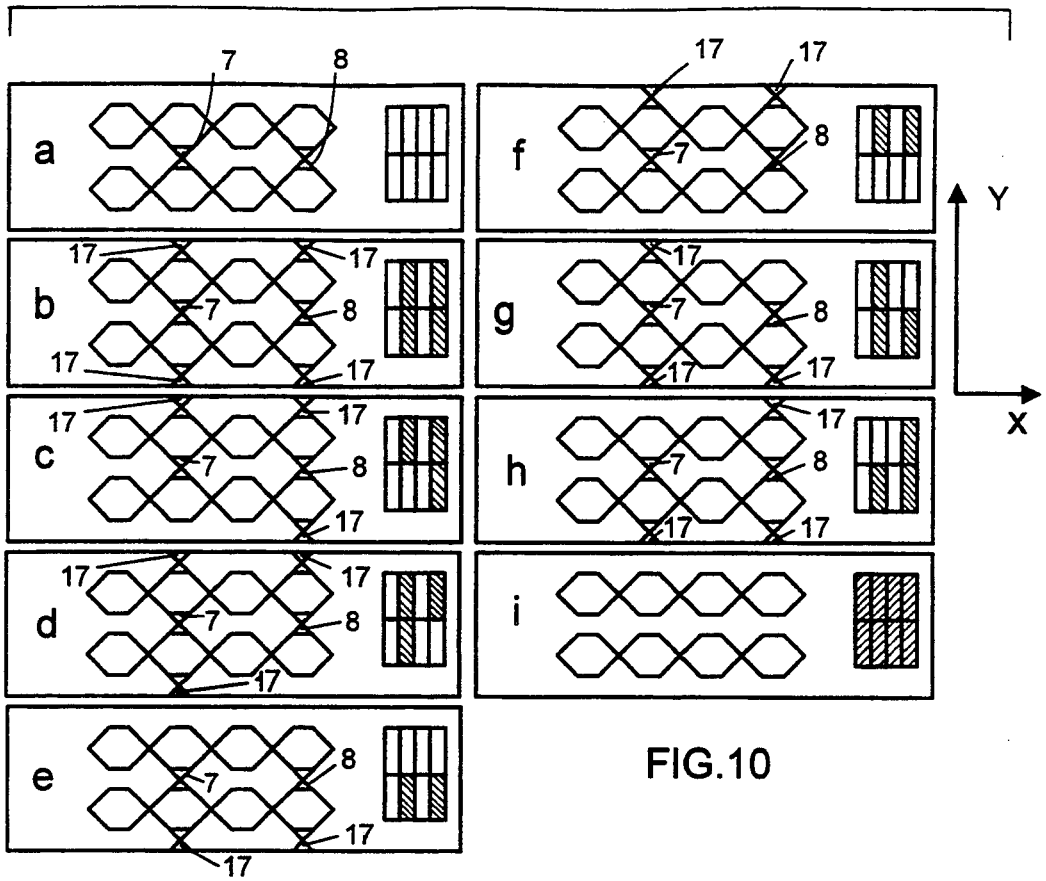
FIG. 10 illustrates, in FIGS. 10*a* to FIG. 10*h*, eight variations of track module combinations which can be used in accordance with the invention to achieve different lacing patterns and interlocking sequences between layers.

Referring now to FIG. 10, this Figure shows the serpentine paths of a set of track modules all based on the configuration of two gear modules as shown in FIG. 4, i.e. the gears are arranged in two rows of four beneath the corresponding track module. These are the simplest and the basic combinations from which a wide range of composite braided interlocked structures can be built. To the right of the serpentine paths is shown a module notation.

In FIG. 10*a* the basic track module described with reference to FIG. 7 is illustrated and the notation to the right shows eight blank areas. It will be noted that there are two in-module changeover points 7, 8 and thus it is only possible with this track module to create two layers of interlocked braided material and it is not possible to take the package carriers out of the serpentine paths defined by the module into adjacent layers.

However, in FIGS. 10*b* to 10*h* out-module transfer is possible. In these Figures each of the transfer points is referred to by the reference 7 and wherever an out-module changeover occurs in the module notation, the transfer is indicated by a hatching. Thus in FIG. 10*b* it is possible to obtain two out-module changeovers in the layer above the module and also in the layer below the module. Thus the track module of FIG. 10*b* would be useful as a track module in a thick braided structure where it is used as an intermediate rather than an edge module.

In FIG. 10*c* the module has two out-module changeovers above the track module and one below, to the right-hand side. The notation in the block diagram indicates this. This type of module is very useful where a shaped braid structure is being constructed and can be used as an internal corner point as will be explained later.

FIG. 10*d* is similar to FIG. 10*c* except that the out-module changeover is at the left, below the module, rather than the right.

In FIG. 10*e* a track module is shown which is useful in application in constructing an edge layer of a module. There are no out-module changeovers at the top of the track module, but two at the bottom. The converse of this is shown in FIG. 10*f* where there are two out-module changeovers at the top of the track module and none at the bottom.

FIGS. 10*g* and 10*h* are converse track modules of FIGS. 10*d* and 10*c* respectively and both have two out-module changeovers at their bottom, but only one at their top, FIG. 10*g* being at the left and FIG. 10*h* on the right. These are noted in the block module notation.

The track module of FIG. 10*i* is not in accordance with the invention, but is in accordance with the prior art. This module may, however, be used conveniently at times in combination with the track modules of the invention. It will be noted that the track module in FIG. 10*i* has no in-module nor out-module changeover points and thus the layers produced will not be interlocked. The block module notation used for this is shown with hatching in the opposite direction to the hatching shown in FIGS. 10*b* to 10*h*.

It will be appreciated that an almost infinite array of modules can be produced building up on the principles shown in FIG. 10. For example, the module illustrated earlier and described with reference to FIG. 7 would, instead of having two gear modules, have four gear modules so that there are eight gears in each row and there are two rows. This concept can be expressed empirically for the modules as $2N \times 2$ where N is an integer with a value of at least two. There is theoretically no upper value to N. Attention is drawn to the fact that each track module represents a repeat of a given serpentine path configuration. This implies that the Y position of a movable package carrier is the same at the beginning and the ending X position for any particular track module configuration.

The layout of track modules to create typical braid structures will now be illustrated by way of example. The module notations to be constructed are as indicated in FIG. 10. The modules will be referred to by the letters a to i.

Figure 11:
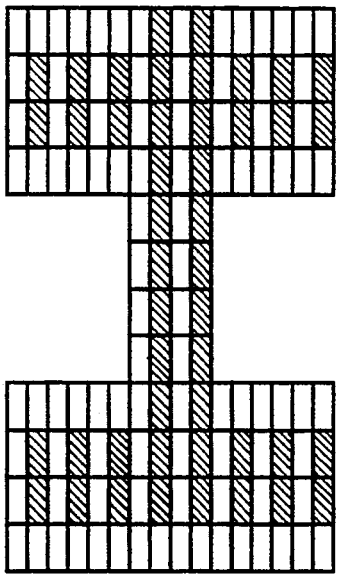
FIG. 11 shows a typical combination of these block modules to form an I interlaced braid structure.
Figure 12:
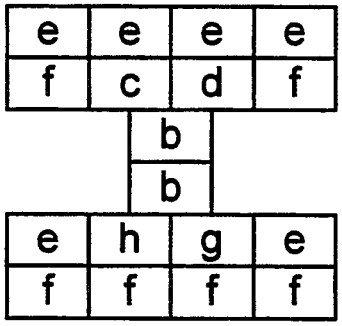
FIG. 12 indicates the specific layout of modules as indicated in FIG. 10 to form the I structure of FIG. 11.
Figure 13:
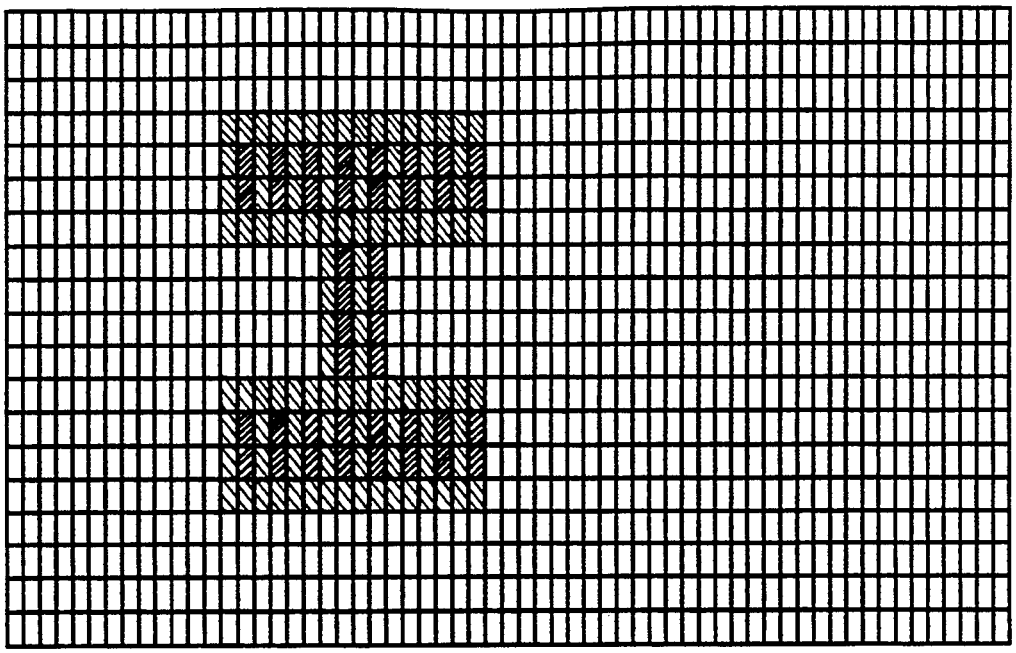
FIG. 13 indicates how the modules would be set out on a universal drive bed to braid up the I structure of FIG. 11.

The first shape to be constructed will be the I configuration as is shown in FIG. 11. The track modules will be assembled arranged as shown in FIG. 12 and disposed on a base as shown in FIG. 13. In FIG. 12 the individual track modules are referred to by the letters of FIG. 10. It should be noted that the boundary or edge modules e and f are used at the top and bottom of the braid structure and also that the central span of the I shape extends over two modules and it is not necessary for the modules to be aligned one on top of the other. However, the out-module changeovers of adjacent modules must, of course, be coincident to enable the interlacing which is required to take place so that the required changeover of package carriers between paths takes place.

Thus considering FIGS. 11, 12, 13 and 16 it will be seen that the top layer of modules are all e modules to produce a top edge or boundary surface. In the second layer of modules from the top, starting from left to right, the module f is selected so that there are two out-module changeovers 17 above it but none below it so that below the module there is a clean edge. The next module c requires a clean edge for the first part of the module but requires an out-module changeover path to cooperate with the module b below it. Furthermore, two out-module changeovers are required at the top to ensure interlacing of the layers with the top two layers of the modules e. The next module, which is a d, is a reflection of module c and requires one out-module changeover on the lower path only to cooperate with the changeover of module b. The final module is module f which has no out-module changeovers 17 at the lower boundary surface and this results in a braid structure which presents an un-interlocked bottom layer but strong interlocking at two out-module changeovers with the contiguous module e.

The two vertical modules b interlock at the second and fourth positions, although it will be appreciated that if required the module b could be inverted so that it interlocked at the first and third positions in which case the modules in the centre of the second layer would be inverted g and h modules respectively.

In the lower limb of the I structure the bottom layer is constructed with f modules so that a lower edge or boundary surface with no out-module changeover is presented. The two corner modules are e modules again to secure the boundary edge with no out-module changeovers on the top side and in order to ensure interlocking on one side only, whereas the two central modules are h and d modules interlocking with the f modules on one side and the b modules on the other.

Figure 14:
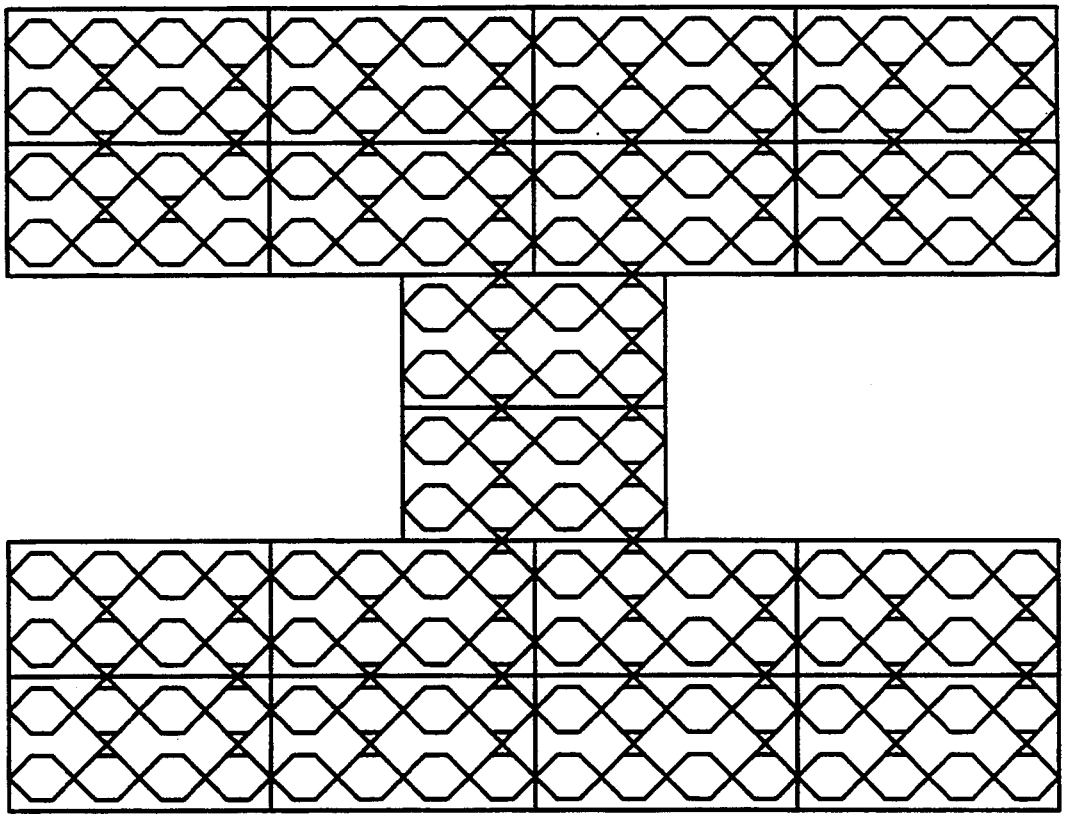
FIG. 14 sets out the path patterns for the module arrangement of FIG. 13.

An inspection of FIG. 14, which shows the track serpentine paths in different shading for the I structure of FIG. 12, illustrates how there are out-module changeovers at each possible position as well as in-module changeovers wherever possible throughout the whole of the structure to give a strongly interlocked braid structure.

By use of this configuration of modules a braided structure is able to be formed in which each layer is fully interlocked with the next layer and no external connections between layers have to be applied. Furthermore, each open edge of the layers are sealed and there are no stray ends of filaments.

In practice, the braiding apparatus would comprise a universal drive bed as is shown in FIG. 13 upon which the gear modules would be assembled according to the configuration required and according to the size required. In the example given in FIG. 13, the track module layout station is illustrated which is positioned above the necessary gear modules. It will be noted that in this example, only part of the drive bed is used and thus it is possible on one drive bed to set up not only a structure of an I configuration of different dimensions, but also to set up other configurations. One such an alternative configuration is shown in FIG. 15, to which reference is now made.

Figures 15, 16, 17:
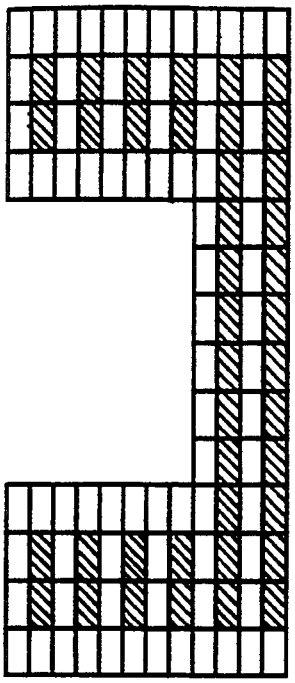
FIGS. 15 and 16 show the module and block layout for a different shape of braider structure, in this case a reversed C.
FIG. 17 is a variation of this structure showing a combination of modules using the invention and modules with no interlacing, such as is shown in FIG. 10*i*.

In FIG. 15 a module notation arrangement is shown for making a reversed C braid structure. The track module arrangement necessary is illustrated in FIG. 16. Again the top and the bottom lines of the structure are e and f modules to ensure that there is no out-module changeover at the edges and that the structure formed has a clean top and bottom boundary surface. Also, b modules are used to construct the vertical spine layers of the braided structure. This then is a simple arrangement requiring only three different types of module.

A variation of the reverse c structure is shown in FIG. 17 where use is also made of the i modules of FIG. 10. This arrangement of modules gives rise to a somewhat looser structure since interlacing will only occur in those areas where modules other than i modules are present.

The invention enables very strong braid structures to be created with interlocked layers; such structures may be used either on its own or may be impregnated with a resin, for example, to form a composite braid structure. The degree of interbraiding between layers can be varied as has been explained, but for the strongest structure where an out-module changeover takes place at every alternate gear position, be it either the 1st, 3rd, 5th etc. or the 2nd, 4th, 6th etc., an extremely solid structure is obtained merely by the braiding action.

The configuration of braided structures which are fully interlocked are not limited to the I or reverse C structures shown, but may by judicial selection of the track modules be used to create a whole range of interlocked braid structures. The structures are readily extendable in the X direction where no out-module changeover is necessary and selection of the correct track module is only necessary in the Y direction.

If reinforcing elements are used in the Z direction from stationary yarn package carriers in accordance with FIG. 9, then even further strength is added to the final structure.

Figure 18:
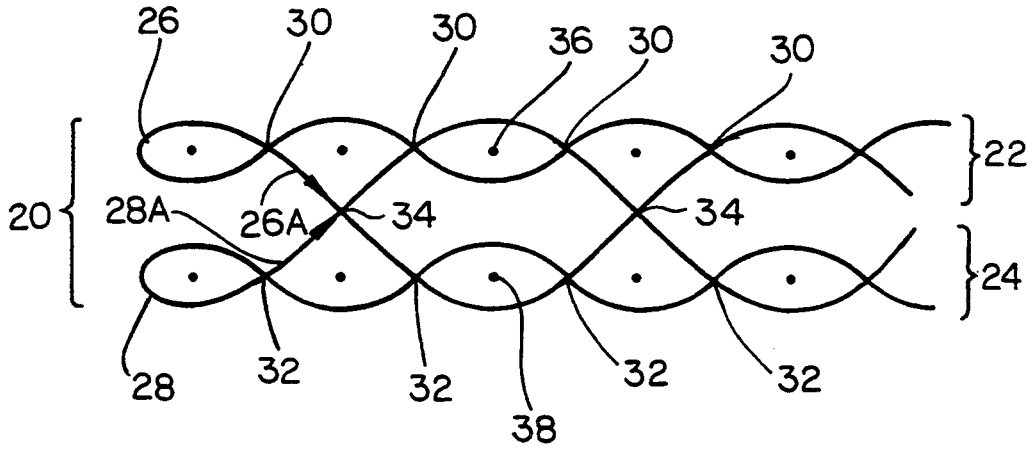
FIG. 18 shows a cross sectional view of a braid structure obtained from the track module of FIG. 9.

The resulting structure 20 shown in FIG. 18 consists of two layers 22, 24 each formed of yarns 26, 28. Each yarn follows serpentine paths within the layer which cross over in opposite directions at layer crossover points such as 30 and 32. Between layers 22, 24 there are provided interlayer crossover points 34. In the embodiment shown, the distance between the interlayer crossover points 34 is twice the distance between the layer crossover points 30, 32. Each interlayer crossover point 34 is defined by a yarn such as 26A crossing over from layer 22 to layer 24 and a yarn such as 28A crossing over from layer 24 to layer 22. Thus at the interlayer crossover points, yarns 26A, 28A pass each other in the same direction and replace each other within the respective layers 22, 24. Stationary yarns 36, 38 may be added in each layer 22, 24 as reinforcing elements as discussed above.

In view of the large range of structures able to be produced by the correct selection of modules, it is very convenient to use a CADCAM system for designing any configuration of braid structure. A suitable computer program can be written which acknowledges the properties and limitations of each of the modules and it can then take account of information fed to it regarding the shape, dimension and degree of interlocking required in the final braided structure in order to produce the required layout. The output from any computer into which the computer program is fed can then be used to operate a robotic system which can transfer the modules onto the bed plate of FIG. 14 and load on package carriers, both static and movable, as required and set up the whole system.

The system can further be extended so that the optimum ratio of braider package travelling speed to the braid linear speed for the yarn being used and the angles at which it is delivered can be automated as can the substitution of new packages for exhausted yarn package carriers.

We claim:

1. A braid structure comprising:

a plurality of interlocked contiguous layers, each layer formed of yarns extending in serpentine paths crossing at intralayer crossover points disposed at a first distance; and a plurality of interlayer crossover points between said layers disposed at a second distance larger than said first distance, each interlayer crossover point between two adjacent layers being separated from any other interlayer crossover point between said two adjacent layers by at least two intralayer crossover points, each interlayer crossover point being defined by one yarn from one layer passing to another layer and replacing another yarn from said another layer, and by said another yarn passing from said another layer to said one layer and replacing said one yarn;

said one yarn and said another yarn forming an interlock between said one layer and said another layer.

2. A structure as claimed in claim 1 wherein each layer has an end, and wherein said first yarn at said end is reversed in direction and follows the second serpentine path to interbraid with other yarns to form a flat braid structure.

3. The structure of claim 1 wherein said structure includes a first set of layers having a first width and a second set of layers having a second width different from said first width.

4. A structure as claimed in claim 1 in which the final form of the structure is impregnated with a resin material to form a braid composite structure.

5. A structure as claimed in claim 4 and including yarns impregnated with a resin material.

6. The braid structure of claim 1 wherein said serpentine paths cross at said intralayer crossover points in opposite directions and said one yarn and said another yarn pass each other at said interlayer crossover point in the same direction.

7. The structure of claim 1 wherein each layer includes stationary yarns disposed between adjacent intralayer crossover points.

* * * * *